US007754310B2

(12) United States Patent
Kuo

(10) Patent No.: US 7,754,310 B2
(45) Date of Patent: Jul. 13, 2010

(54) PACKAGING BUFFER MATERIAL

(76) Inventor: Sheng-Hsi Kuo, No. 8, Alley 90, Lane 131, Haipu Roud, Hsinchu City, Taiwan (CN)

( * ) Notice: Subject to any disclaimer, the term of this patent is extended or adjusted under 35 U.S.C. 154(b) by 406 days.

(21) Appl. No.: 11/865,149

(22) Filed: Oct. 1, 2007

(65) Prior Publication Data

US 2009/0022914 A1 Jan. 22, 2009

(30) Foreign Application Priority Data

Jul. 17, 2007 (JP) ..... 2007-005470

(51) Int. Cl.
*B65D 81/133* (2006.01)

(52) U.S. Cl. ..... 428/122

(58) Field of Classification Search ..... 428/122; 206/453, 586; 248/345.1
See application file for complete search history.

(56) References Cited

U.S. PATENT DOCUMENTS 4,759,446 A * 7/1988 Dobashi et al. ..... 206/586
6,357,587 B1 * 3/2002 Melms, Jr. ..... 206/326
6,843,374 B1 1/2005 Li et al.
2002/0166860 A1 11/2002 Giles et al.
2005/0035257 A1 2/2005 Niu et al.

FOREIGN PATENT DOCUMENTS

FR 2411141 7/1979
JP 7-6172 U 1/1995

* cited by examiner

*Primary Examiner*—Alexander Thomas
(74) *Attorney, Agent, or Firm*—Leydig, Voit & Mayer, Ltd.

(57) ABSTRACT

A packaging buffer material includes a pair of outer sidewalls having concave grooves in a length direction, and bottom wall having a concave groove in the length direction, and stoppers, preventing a packing object from being displaced, attached between the sidewalls. If external pressure is applied to the packaging buffer material, the outer sidewalls and concave groove bottoms are deformed. However, because of narrow widths of the concave grooves, the outer sidewalls are not entirely deformed but only the concave grooves are deformed. Due to this, a space can be kept between the sidewalls even if high external pressure is applied to the packaging buffer material.

12 Claims, 8 Drawing Sheets

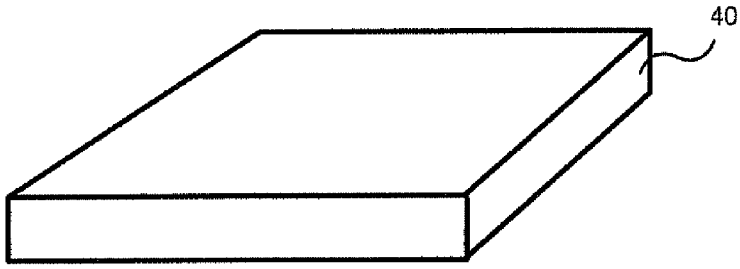
FIG. 7(A)
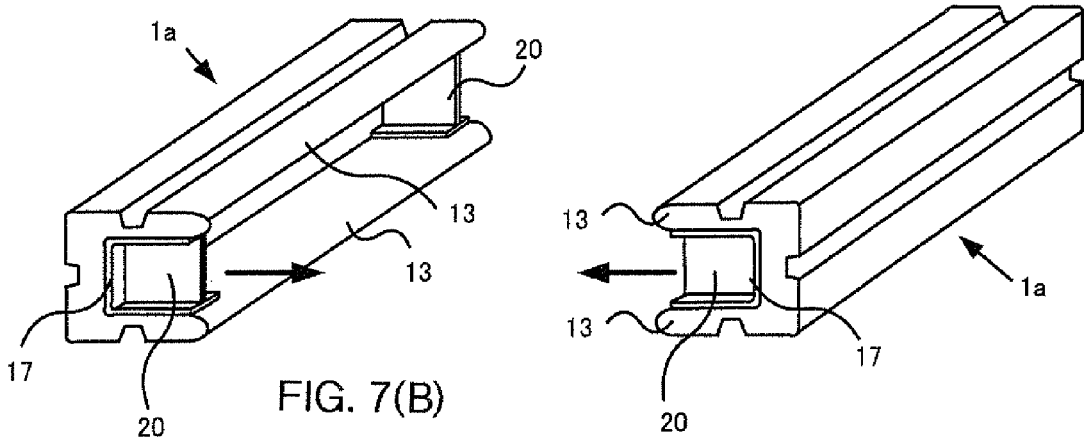
FIG. 7(B)
FIG. 7(C)
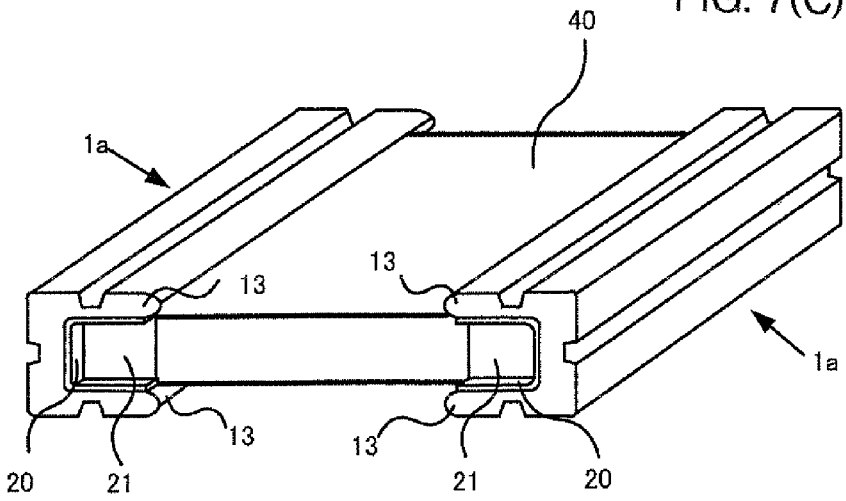

PACKAGING BUFFER MATERIAL

BACKGROUND OF THE INVENTION

1. Field of the Invention

The present invention relates to a packaging buffer material used to packing an article such as electric product, a mechanical component, a mechanical product, a glass or a pottery. The present invention particularly relates to a packaging buffer material and a method of manufacturing a packaging buffer material capable of being manufactured using a simple mold, being mass produced, being recycled, and facilitating packaging operation.

2. Description of the Background Art

Generally, if an article such as electric product, a mechanical component, a mechanical product, a glass or a pottery is to be packed in a cardboard box, a packaging box or the like, a buffer material is disposed between the packaging box and the article so as not to damage the article. Conventionally, a partition plate consisting of expanded polystyrene resin or thick corrugated cardboard is used as such a packaging buffer material. The partition plate is used by assembling a necessary number of corrugated cardboards corresponding to a shape or a magnitude of the article.

Figure 8:
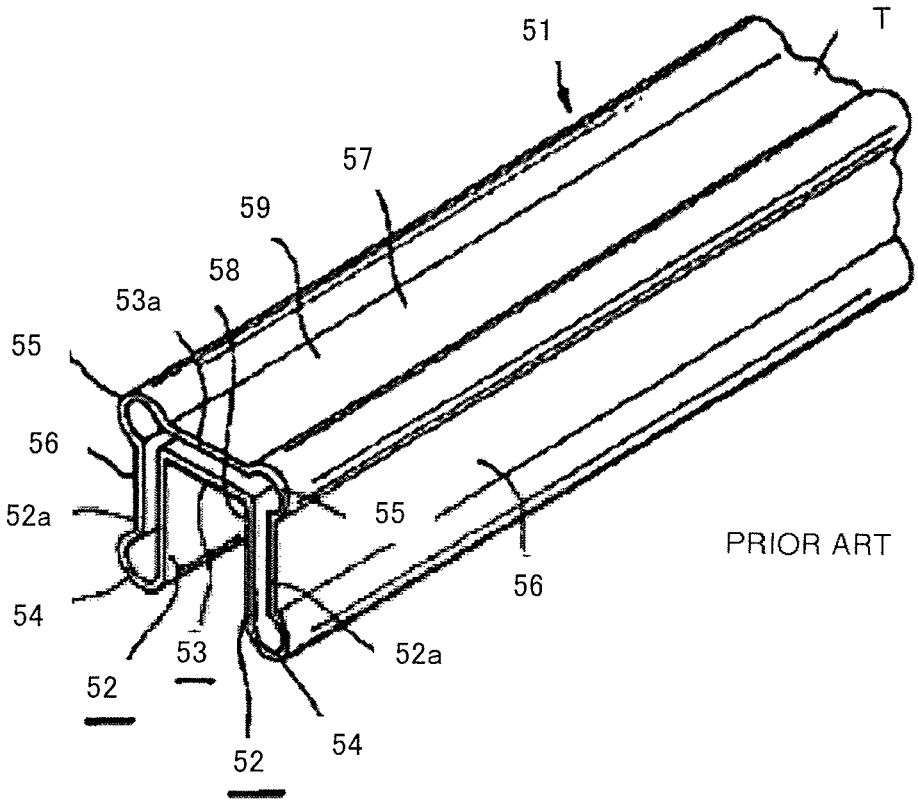

A conventional packaging buffer material is disclosed in, for example, Patent Document 1 (Japanese Utility Model Registration NO. 2607208). FIG. 8 is a schematic diagram showing a conventional packaging buffer material disclosed in the Patent Document 1. In FIG. 8, a packaging buffer material 51 is configured to include a tubular member T consisting of paper or a composite material mainly containing paper and having a generally U-shaped cross section. The packaging buffer material 51 is configured to include a pair of opposed portions 52 and a coupling portion 53 coupling side edges of the opposed portions 52 to each other.

The tubular member T is configured to include a first constituent element 58 having a generally U-shaped cross section, a second constituent element 59 having a generally U-shaped cross section and arranged outside of the first constituent element 58 to be distanced from the first constituent element 58, and two connection circular arc elements 54 having circular arc cross sections and connecting two edges of the first constituent element 58 to those of the second constituent element 59, respectively. Concave grooves 56 and 57 depressed toward the first constituent element 58, i.e., depressed inward of the tubular member T and extending in a length direction are formed in portions forming outer sidewalls 52*a* of the opposed portions 52 and an outer sidewall 53*a* of the coupling portion 53 of the packaging buffer material 51 in the second constituent element 59, respectively.

Further, coupling portions 55 coupling portions forming the outer sidewalls 52*a* of the opposed portions 52 of the tubular member T to a portion forming the outer sidewall 53*a* of the coupling portion 53 in the first constituent element 59 are formed to have circular arc cross sections, respectively. The packaging buffer material 51 is produced by, for example, winding the composite material consisting of paper or mainly containing paper around a mold having a shape corresponding to that of the packaging buffer material 51 by spiral winding or plane spiral winding. Furthermore, the packaging buffer material 51 is produced by forming a long tubular member using the composite material consisting of paper or mainly containing paper by some method and then cutting off the long tubular member.

However, the conventional packaging buffer material has the following problems. If a strong force is applied to the packaging buffer material from a lateral or longitudinal direction, the paired opposed portions 52*a* and the outer sidewall 53*a* are depressed inward. At this time, because of large widths of the concave grooves 56 and 57, the outer sidewalls 52*a* contact with the respective opposed portions 52 and the outer sidewall 53*a* contacts with the coupling portion 53. As a result, external pressure may possibly directly damage an article packed in the packaging buffer material 51. Moreover, since both ends of the packaging buffer material 51 are opened, the internal article directly packed in the packaging buffer material 51 may possibly be displaced laterally.

SUMMARY OF THE INVENTION

The present invention has been achieved in view of the above-stated problems. It is an object of the present invention to provide a packaging buffer material capable of improving absorbability with respect to an impact force without compressing an internal packing object even if external pressure is applied to the packaging buffer material after the packing object is packed up in the packaging buffer material.

To solve the problems, a packaging buffer material according to a first aspect of the present invention is characterized by comprising: concave grooves formed in central portions of a pair of outer sidewalls in a length direction, respectively; and stoppers attached between inner sidewalls opposed to the respective outer sidewalls and an inner bottom wall opposed to an outer bottom wall.

A packaging buffer material according to a second aspect of the present invention is characterized by further comprising a concave groove formed in a central portion of the outer bottom wall in the length direction.

A packaging buffer material according to a third aspect of the present invention is characterized in that each of inside corners of the packaging buffer material is formed into a circular arc shape.

A packaging buffer material according to a fourth aspect of the present invention is characterized in that an outer sidewall of each of the stoppers is formed into a U-shape, and a partition plate is formed at a center of the outer sidewall of each of the stopper.

A packaging buffer material according to a fifth aspect of the present invention is characterized in that an outer sidewall of the stopper is formed into a U-shape.

A packaging buffer material according to a sixth aspect of the present invention is characterized in that an outer sidewall of the stopper is formed into a U-shape, and a partition plate is formed on an end of the outer sidewall of each of the stoppers.

A method of manufacturing a packaging buffer material according to a seventh aspect of the present invention includes the steps of: forming a plate member by piling and compressing a plurality of corrugated cardboards; forming a tubular member by rolling up the plate member; forming a U-shaped sleeve by inserting a U-shaped mold into the tubular member and compressing the tubular member from outside; and attaching stoppers manufactured separately to both ends of the U-shaped sleeve, respectively.

EFFECT OF THE INVENTION

The packaging buffer material according to the first aspect of the present invention is configured to include concave grooves formed in central portions of a pair of outer sidewalls in a length direction, respectively; and stoppers attached between inner sidewalls opposed to the respective outer sidewalls and an inner bottom wall opposed to an outer bottom wall. Due to this, even if external pressure is applied to the packaging buffer material after a packing object is packed up in the packaging buffer material, absorbability with respect to an impact force can be improved without compressing the internal packing object. It is, therefore, possible to safely transport the packing object. Furthermore, the packaging buffer material according to the first aspect of the present invention can be made of recycled paper and is recyclable accordingly. Moreover, since the packaging buffer material can be manufactured by one compression process, high mass productivity can be ensured. Moreover, since the recycled paper can be recycled, it is advantageously possible to solve pollution problems while reducing a manufacturing cost by use of the inexpensive material.

The packaging buffer material according to the second aspect of the present invention is configured to further include a concave groove formed in a central portion of the outer bottom wall in the length direction. Due to this, even if external pressure is applied from the bottom to the packaging buffer material after the packing object is packed up in the packaging buffer material, the absorbability with respect to the impact force can be further improved without compressing the internal packing object. It is, therefore, possible to transport the packing object safely.

The packaging buffer material according to the third aspect of the present invention is configured so that each of inside corners of the packaging buffer material is formed into a circular arc shape. Due to this, even if external pressure is applied to the packaging buffer material after the packing object is packed up in the packaging buffer material, it is possible to improve the absorbability with respect to the impact force.

The packaging buffer material according to the fourth aspect of the present invention is configured so that an outer sidewall of each of the stoppers is formed into a U-shape, and so that a partition plate is formed at a center of the outer sidewall of each of the stopper. Due to this, it is possible to prevent the packing object from being displaced laterally.

The packaging buffer material according to the fifth aspect of the present invention is configured so that an outer sidewall of the stopper is formed into a U-shape. Due to this, it is possible to prevent the packing object from being displaced laterally.

The packaging buffer material according to the sixth aspect of the present invention is configured so that an outer sidewall of the stopper is formed into a U-shape, and a partition plate is formed on an end of the outer sidewall of each of the stoppers. Due to this, it is possible to prevent the packing object from being displaced laterally.

The method of manufacturing a packaging buffer material according to the seventh aspect of the present invention includes the steps of forming a plate member by piling and compressing a plurality of corrugated cardboard paper sheets; forming a tubular member by rolling up the plate member; forming a U-shaped sleeve by inserting a U-shaped mold into the tubular member and compressing the tubular member from outside; and attaching stoppers manufactured separately to both ends of the U-shaped sleeve, respectively. Due to this, the packaging buffer material can be manufactured by one compression process, so that high mass productivity can be ensured. Moreover, since the recycled paper can be recycled, it is advantageously possible to solve pollution problems while reducing a manufacturing cost by use of the inexpensive material.

BRIEF DESCRIPTION FOR THE DRAWINGS

Figure 1A:
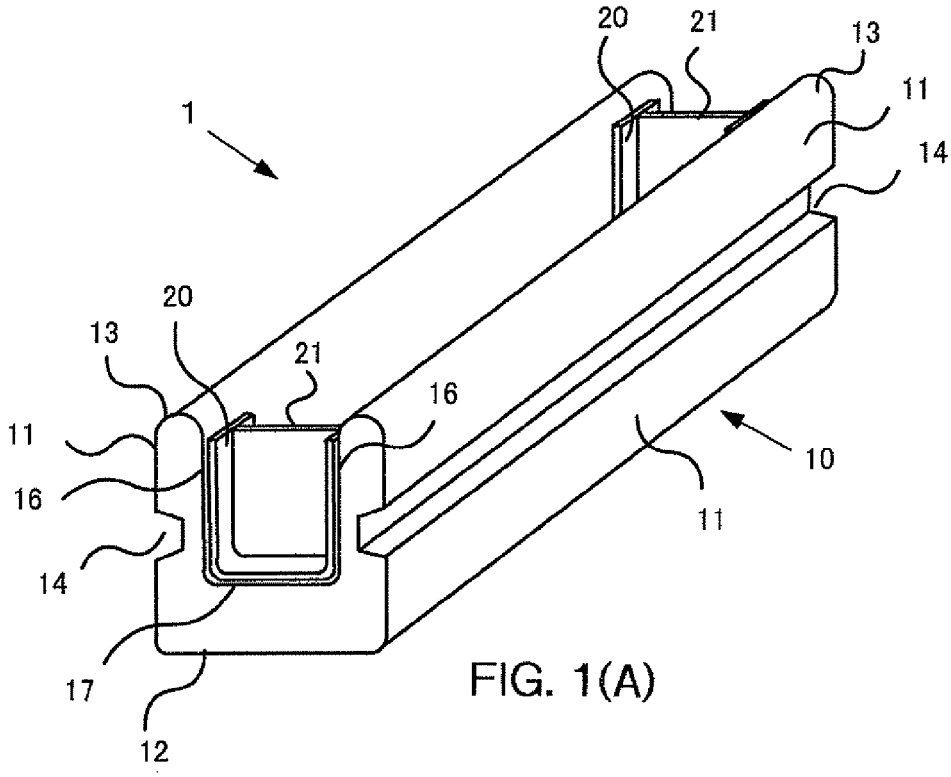
Figure 1B:
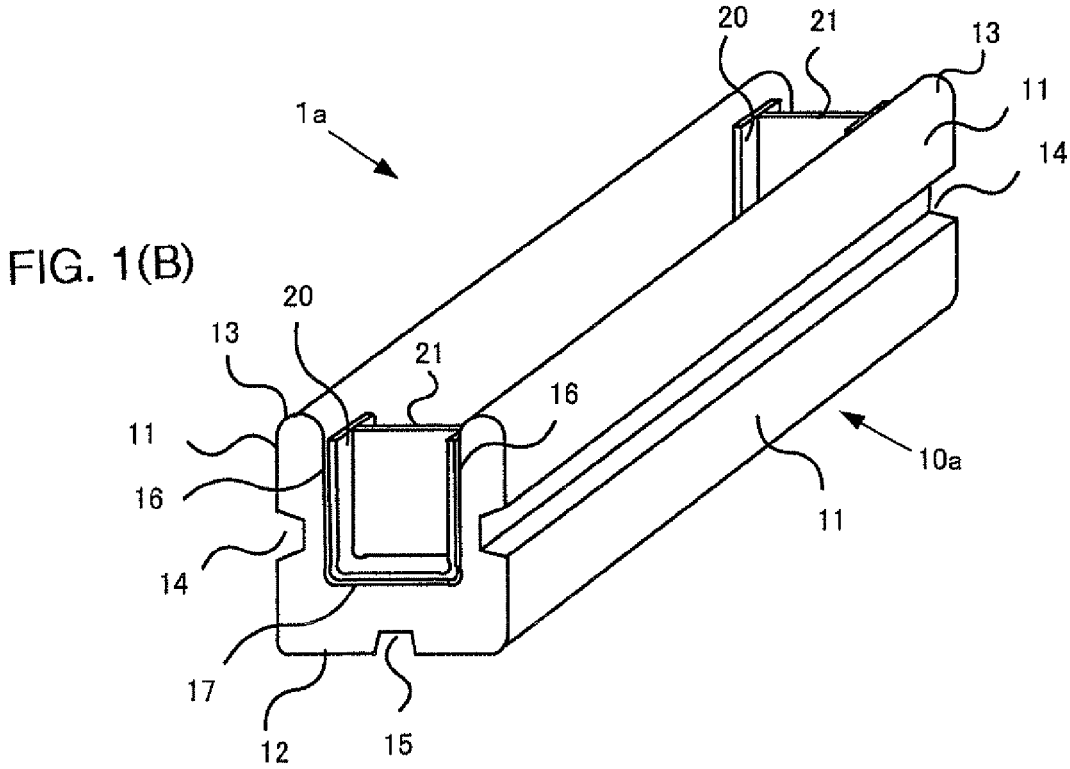

FIGS. 1(A) and 1(B) are schematic diagrams respectively showing packaging buffer materials according to first and second embodiments of the present invention.

Figure 2A:
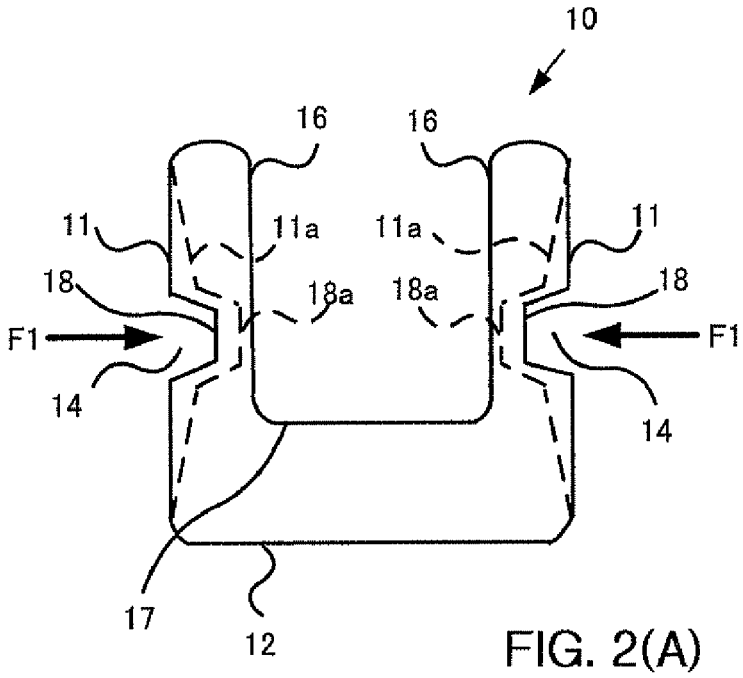
Figure 2B:
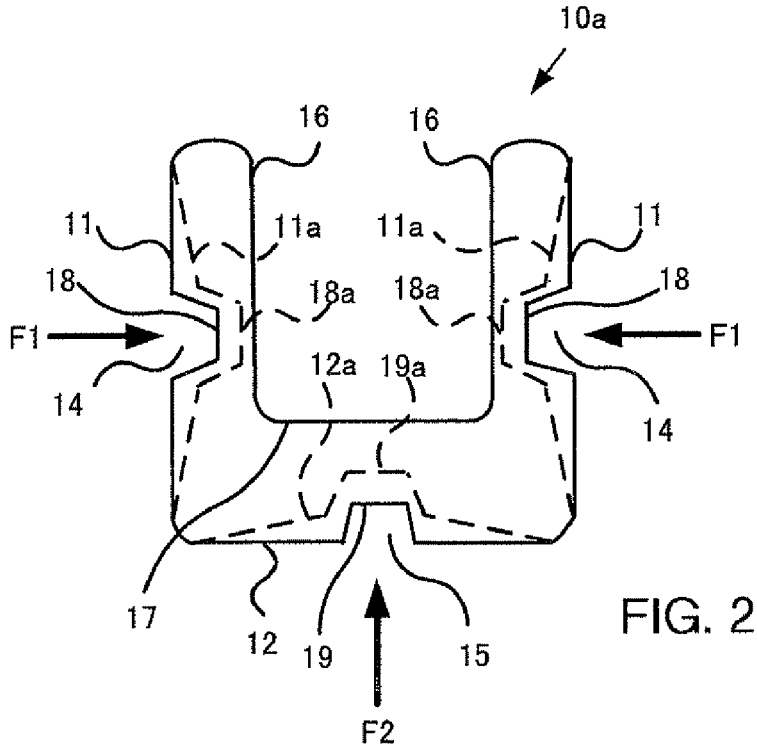

FIGS. 2(A) and 2(B) are schematic diagrams explaining deformations of the packaging buffer materials due to external pressure according to the first and second embodiments, respectively.

FIGS. 3(A), 3(B), 3(C), and 3(D) are schematic diagrams explaining steps of manufacturing the packaging buffer material according to the first and second embodiments.

Figure 4A:
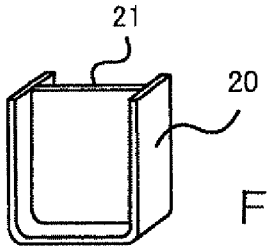
Figure 4B:
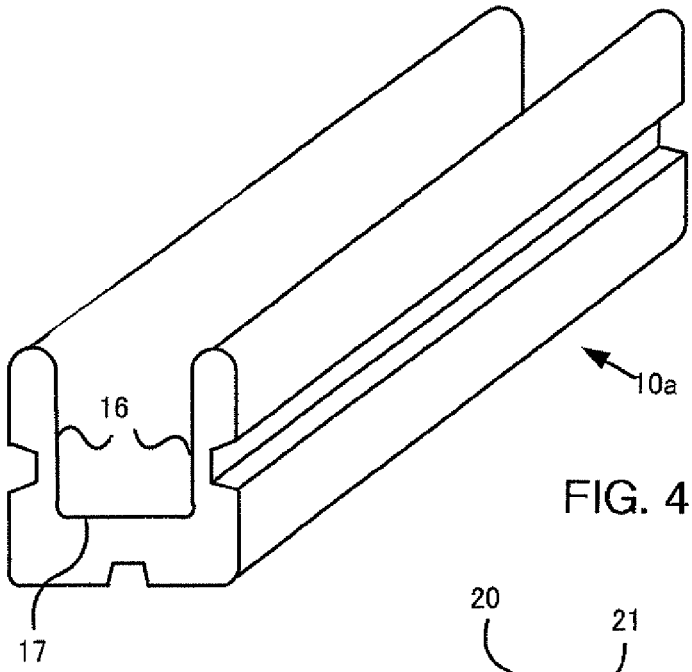
Figure 4C:
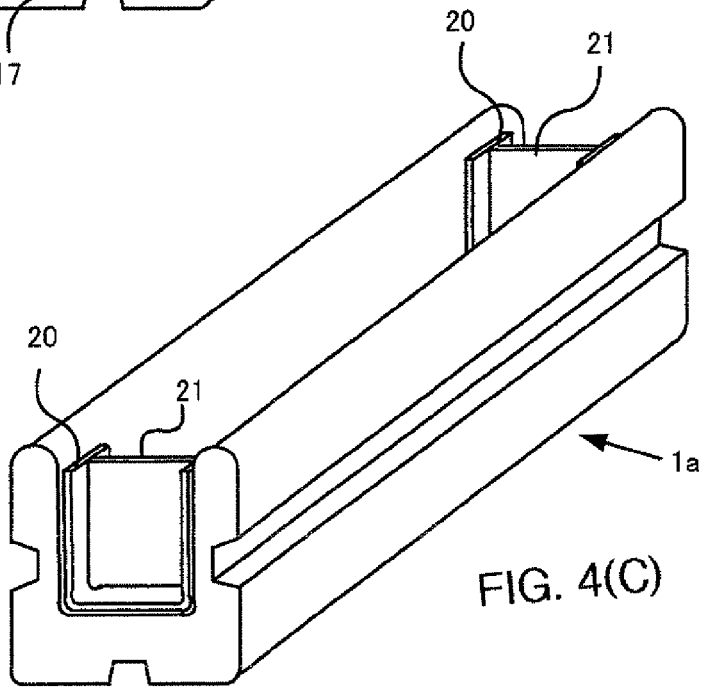

FIGS. 4(A), 4(B) and 4(C) are schematic diagrams explaining stoppers of the packaging buffer material according to the first embodiment.

Figure 5A:
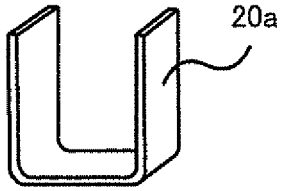
Figure 5B:
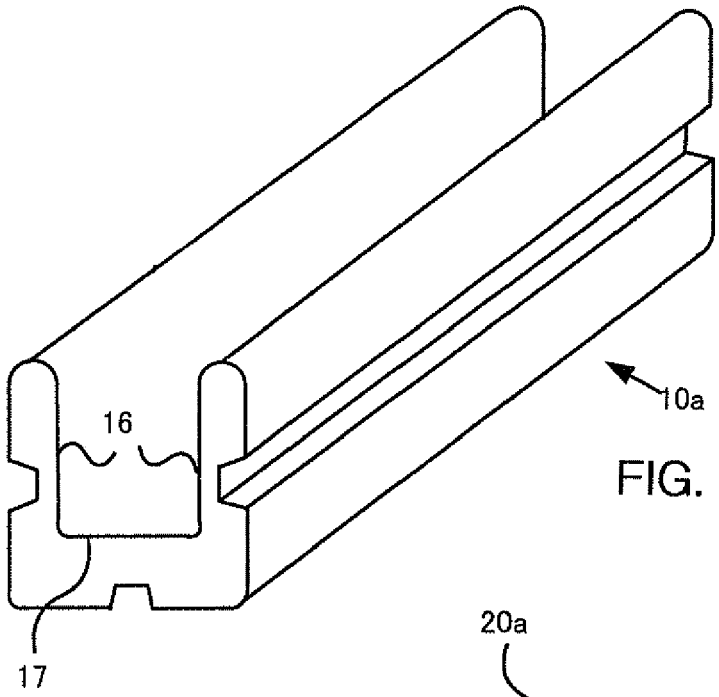
Figure 5C:
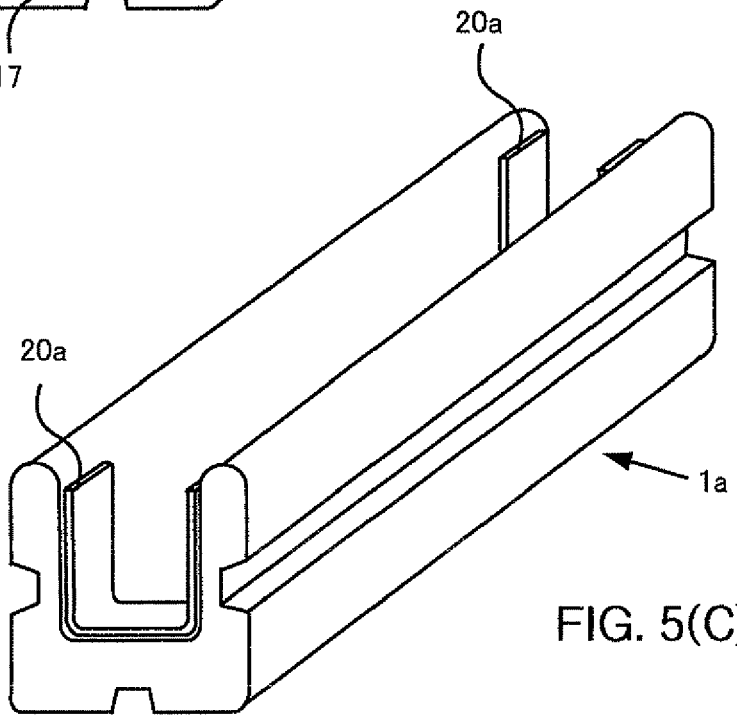

FIGS. 5(A), 5(B) and 5(C) are schematic diagrams explaining stoppers of the packaging buffer material according to the second embodiment.

Figure 6A:
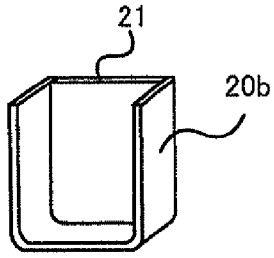
Figure 6B:
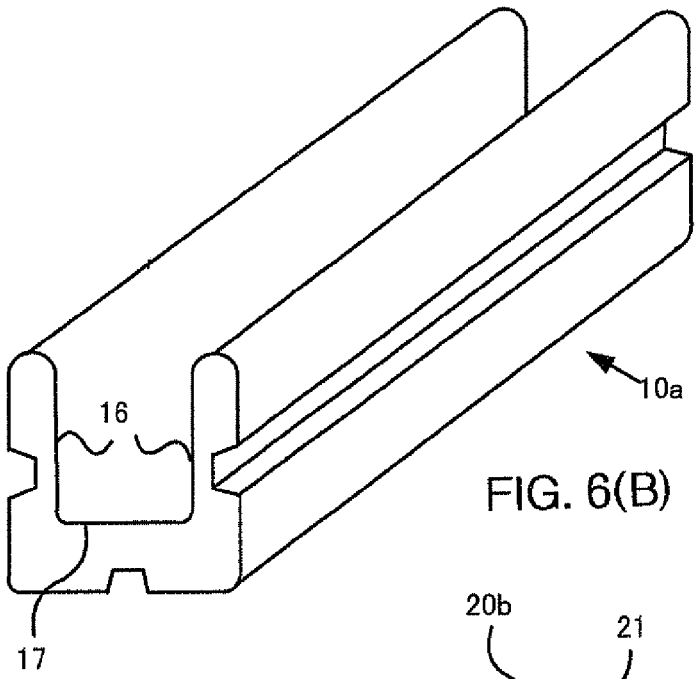
Figure 6C:
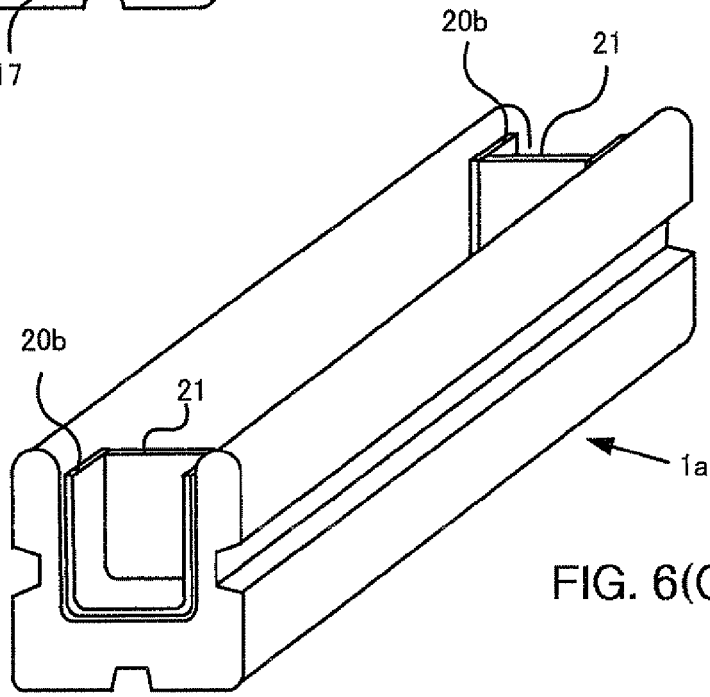

FIGS. 6(A), 6(B) and 6(C); are schematic diagrams explaining stoppers of the packaging buffer material according to a third embodiment of the invention.

FIGS. 7(A), 7(B) and 7(C) are schematic diagrams explaining how to use the packaging buffer material according to one embodiment of the present invention.

FIG. 8 is a schematic diagram showing a conventional packaging buffer material disclosed in a Patent Document 1.

DETAILED DESCRIPTION OF THE PREFERRED EMBODIMENTS

Embodiments of the present invention will be described hereinafter referring to the accompanying drawings. FIG. 1 is a schematic diagram showing a packaging buffer material according to one embodiment of the present invention. FIG. 1(A) is a perspective view showing entirety of a packaging buffer material 1 having concave grooves formed only on surfaces of outer sidewalls 11, respectively. The packaging buffer material 1 is configured to include a U-shaped sleeve 10. The U-shaped sleeve 10 is configured to include two outer sidewalls 11 an outer bottom wall 12, two sidewall upper portions 13, inner sidewalls 16, an inner bottom wall 17, and concave grooves 14 formed on surfaces of the respective outer sidewalls 11. Furthermore, the packaging buffer material 1 includes stoppers 20 provided in portions held between the inner sidewalls 16 and the inner bottom wall 17 on both ends of the packaging buffer material 1, respectively. The stoppers 20 will be described later.

FIG. 1(B) is a perspective view showing entirety of a packaging buffer material 1 having concave grooves formed not only on surfaces of the outer sidewalls 11 but also those of the outer bottom wall 12. The packaging buffer material 1*a* is configured to include a U-shaped groove 10*a*. The U-shaped sleeve 10*a* is configured to include two outer sidewalls 11, the outer bottom wall 12, the two sidewall upper portions 13, the inner sidewalls 16, the inner bottom wall 17, concave grooves 14 formed on surfaces of the respective outer sidewalls 11, and a concave groove 15 formed on a surface of the outer bottom wall 12. Furthermore, the packaging buffer material 1*a* includes stoppers 20 provided in portions held between the inner sidewalls 16 and the inner bottom wall 17 on both ends of the packaging buffer material 1*a*, respectively. The stoppers 20 will be described later.

A packing object 40 is inserted between the two inner sidewalls 16, the inner bottom walls 17, and partition plates 21 of the stoppers 20 of the U-shaped sleeves 10*a*. The packing object 40 is packed in the packaging buffer materials 1*a* while being held between the inner sidewalls 16, the inner bottom walls 17, and the partition plates 21 of the stoppers 20. Due to this, after being packed in the packaging buffer materials 1*a*, the packing object 40 is completely fixed and can be prevented from being displaced laterally.

FIG. 2(A) shows a state of a deformation of the outer sidewalls 11 if external pressure is applied to the U-shaped sleeve 10 from a direction of each of the outer sidewalls 11. In FIG. 2(A), if external pressure F1 is applied to the U-shaped sleeve 10 from the direction of each of the outer sidewalls 11, the outer sidewalls 11 and the concave groove bottoms 18 are deformed in directions in which the external pressure F1 is applied, respectively. However, because of narrow widths of the concave groove bottoms 18, the outer sidewalls 11 are not entirely deformed but only the concave groove bottoms 18 are deformed. Due to this, the entire outer sidewalls 11 are out of contact with the respective inner sidewalls 16, and the space can be kept between the outer sidewalls 11 and the inner sidewalls 16 even if a high external pressure is applied to the U-shaped sleeve 10. Therefore, even if the high external pressure is applied from the direction of each of the outer sidewalls 11, the U-shaped sleeve 10 is not greatly deformed but can protect the packing object 40 packed inside from impact.

FIG. 2(B) shows a state of a deformation of the outer sidewalls 11 and the outer bottom wall 12 if external pressure is applied to the U-shaped sleeve 10*a* from each of directions of the outer sidewalls 11 and that of the outer bottom wall 12. In FIG. 2(B), the external pressure from each of the directions of the outer sidewalls 11 is the same as that described above and will not be described herein. Only an instance in which external pressure is applied from the direction of the outer bottom wall 12 will be described. Even if a force F2 is applied to the U-shaped sleeve 10*a* from the direction of the outer bottom wall 12, the outer bottom wall 12 and the inner bottom wall 17 are similarly deformed. Due to this, the U-shaped sleeve 10*a* is not greatly deformed and can protect the packing object 40 packed inside from impact.

FIG. 3 is a schematic diagram explaining steps of manufacturing the packaging buffer material according to one embodiment of the present invention. FIG. 3(A) shows a plurality of corrugated cardboards 30. A plate member (not shown) is formed by piling and compressing the corrugated cardboards 30. FIG. 3(B) shows a state in which the corrugated cardboards 30 formed as shown in FIG. 3(A) are rolled up, connection portions 33 on ends are connected to each other, and a tubular member 31 is formed. A tubular member interior 32 forming a space is formed in the tubular member 31.

Figure 3A:
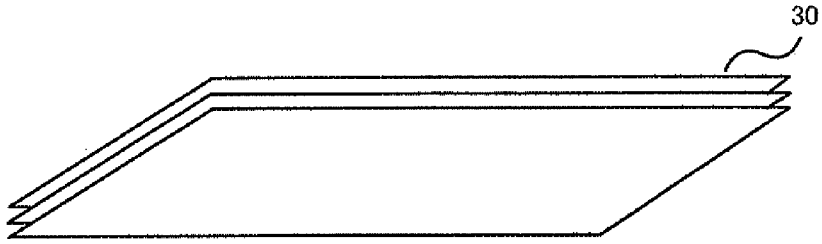
Figure 3B:
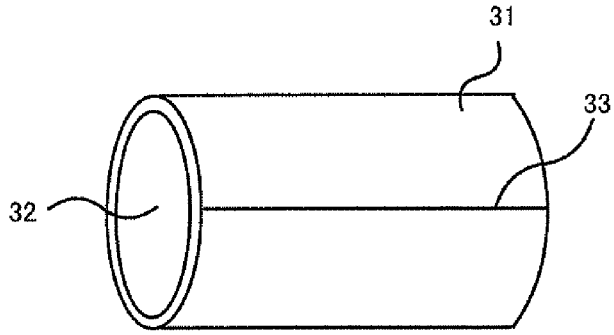
Figure 3C:
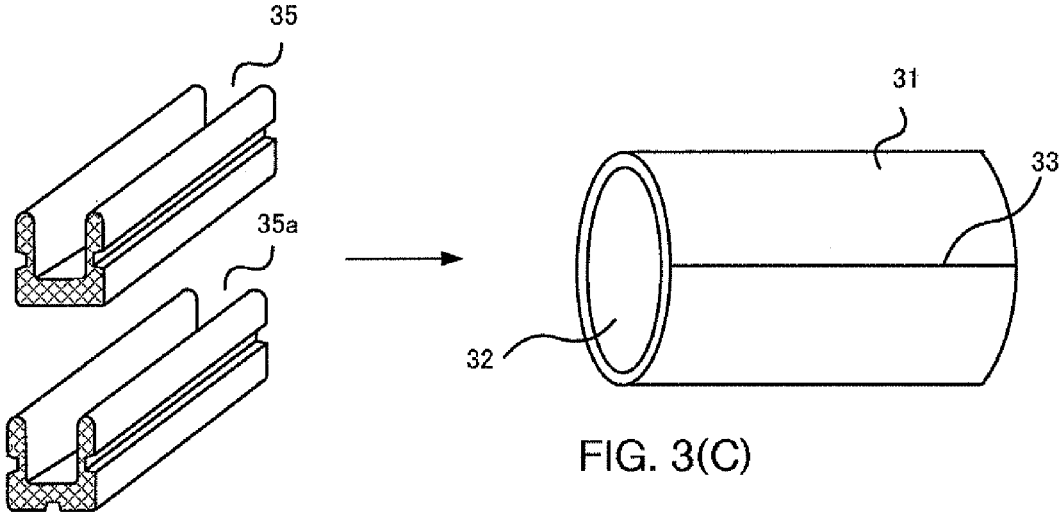
Figure 3D:
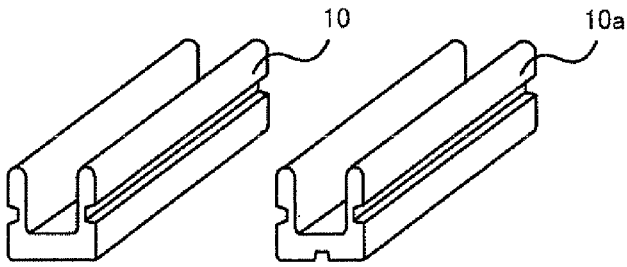

FIG. 3(C) shows a state before a mold 35 for the U-shaped sleeve 10 or 10*a* is inserted into the tubular member interior 32 of the tubular member 31 formed as stated above. Examples of the mold 35 include a mold 35 having no concave groove 15 on the outer bottom wall 12 and corresponding to FIG. 1(A), and a mold 35*a* having the concave groove 15 on the outer bottom wall 12 and corresponding to FIG. 1(B). After the mold 35 or 35*a* is inserted into the tubular member interior 32, the tubular member 31 is compressed using a mold (not shown) from outside of the tubular member 31, and the U-shaped sleeve 10 or 10*a* is formed as shown in FIG. 3(D). In FIG. 3(D), depending on the mold 35 or 35*a* inserted into the tubular member 31, the U-shaped sleeve 10 having no concave groove 15 on the outer bottom wall 12 shown in FIG. 1(A) or the U-shaped sleeve 10*a* having the concave groove 15 on the outer bottom wall 12 shown in FIG. 1(B) is formed.

FIG. 4 is a schematic diagram explaining the stoppers of the packaging buffer material according to one embodiment of the present invention. In FIG. 4(A), a stopper 20 is formed into a U-shape and the partition plate 21 is inserted into a center of the stopper 20. As shown in FIG. 4(B), the stoppers 20 are inserted into both ends of the U-shaped sleeve 10*a* and fixedly bonded to the U-shaped sleeve 10*a*, respectively. As a result, as shown in FIG. 4(C), the packaging buffer material 1*a* having the stoppers 20 inserted into the respective ends of the U-shaped sleeve 10*a* is formed.

FIG. 5 is a schematic diagram explaining the stoppers of the packaging buffer material according to one embodiment of the present invention. In FIG. 5(A), a stopper 20*a* is formed into a U-shape. As shown in FIG. 5(B), the stoppers 20*a* are inserted into both ends of the U-shaped sleeve 10*a* and fixedly bonded to the U-shaped sleeve 10*a*, respectively. As a result, as shown in FIG. 5(C), the packaging buffer material 1*a* having the stoppers 20*a* inserted into the respective ends of the U-shaped sleeve 10*a* is formed.

FIG. 6 is a schematic diagram explaining the stoppers of the packaging buffer material according to one embodiment of the present invention. In FIG. 6(A), a stopper 20*b* is formed into a U-shape and a partition plate 21 is inserted into an end of the stopper 20*b*. As shown in FIG. 6(B), the stoppers 20*b* are inserted into both ends of the U-shaped sleeve 10*a* and fixedly bonded to the U-shaped sleeve 10*a*, respectively. As a result, as shown in FIG. 6(C), the packaging buffer material 1*a* having the stoppers 20*b* inserted into the respective ends of the U-shaped sleeve 10*a* is formed.

FIG. 7 is a schematic diagram explaining how to use the packaging buffer material according to one embodiment of the present invention. FIG. 7(A) shows the packing object 40. As shown in FIG. 7(B), the packing object 40 is held between the sidewall upper portions 13, the inner bottom walls 17, and the stoppers 20 of two packaging buffer materials 1*a*. By doing so, the packing object 40 can be fixed as shown in FIG. 7(C). If the packing object 40 is fixed using the packaging buffer materials 1*a* in this manner, the packing object 40 floats in a hollow and an impact force applied to the packing object 40 can be absorbed. In FIG. 7(B) or 7(C), the stoppers 20 each formed into the U-shape and each having the partition plate 21 inserted into the center are shown. Alternatively, stoppers 20*a* each formed into a U-shape or stoppers 20*b* each formed into a U-shape and having a partition plate 21*b* inserted into an end may be used as the stoppers.

The embodiments described above are given as examples for explaining the present invention, The present invention is not limited to the above embodiments, and can be variously changed or modified within the scope of the present invention. In the embodiments, it has been described that the packaging buffer materials according to the embodiments can be used for packing an electric product, a mechanical component, a mechanical product, a glass, a pottery or the like. However, the applicable range of the present invention is not limited thereto. For example, the packaging buffer materials according to the embodiments can be used for every packing object including precision measuring equipment, automobile parts, artistic handicrafts, furniture, food, a cosmetic product, chemicals, a musical instrument, medical equipment, and the like.

INDUSTRIAL APPLICABILITY

The packaging buffer material according to the present invention is applicable to packing various types of packing objects.

What is claimed is:

1. A packaging buffer material comprising:

a body with a pair of sidewalls and a bottom wall forming a U-shape sleeve;

concave grooves located in central portions of outside surfaces of the sidewalls and extending in a length direction of the sleeve; and a plurality of stoppers, distinct from and not part of the body, each stopper including a stopper sidewall having a U-shape complementary to the U-shape sleeve and having inside and outside surfaces, wherein at least two of the stoppers are disposed transverse to, between, and attached at the outside surfaces of the stoppers to inside surfaces of the sidewalls of the body, and attached to an inside surface of the bottom wall.

2. The packaging buffer material according to claim 1, further comprising a concave groove located in a central portion of an outer side surface of the bottom wall and extending in the length direction.

3. The packaging buffer material according to claim 2, wherein each of inside corners of the packaging buffer material has a circular arc shape.

4. The packaging buffer material according to claim 2, including partition plates, each partition plate being transverse to and located at a center of the inside surface of the stopper sidewall of a corresponding stopper.

5. The packaging buffer material according to claim 2, including partition plates, each partition plate being transverse to and located at an end of the inside surface of the stopper sidewall of a corresponding stopper.

6. The packaging buffer material according to claim 1, wherein each of inside corners of the packaging buffer material has a circular arc shape.

7. The packaging buffer material according to claim 1, including partition plates, each partition plate being transverse to and located at a center of the inside surface of the stopper sidewall of corresponding stopper.

8. The packaging buffer material according to claim 1, including partition plates, each partition plate being transverse to and located at an end of the inside surface of the stopper sidewall of a corresponding stopper.

9. A packaging buffer material comprising:

a body with a pair of sidewalls and a bottom wall forming a U-shape sleeve;

concave grooves located in central portions of outside surfaces of the sidewalls and extending in a length direction of the sleeve;

a plurality of stoppers, distinct from and not part of the body, each stopper including a stopper sidewall having a U-shape complementary to the U-shape sleeve and having inside and outside surfaces, wherein at least two of the stoppers are disposed transverse to, between, and attached at the outside surfaces of the stoppers to inside surfaces of the sidewalls of the body, and attached to an inside surface of the bottom wall; and partition plates, each partition plate being transverse to and located at a center of a inside surface of the stopper sidewall of a corresponding stopper.

10. The packaging buffer material according to claim 9, further comprising a concave groove located in a central portion of an outer side surface of the bottom wall and extending in the length direction.

11. The packaging buffer material according to claim 10, wherein each of inside corners of the packaging buffer material has a circular arc shape.

12. The packaging buffer material according to claim 9, wherein each of inside corners of the packaging buffer material has a circular arc shape.

* * * * *